US006955502B2

(12) United States Patent
Warren

(10) Patent No.: US 6,955,502 B2
(45) Date of Patent: Oct. 18, 2005

(54) METHOD FOR REPAIRING IN-GROUND TUNNEL STRUCTURES

(76) Inventor: Daniel Warren, 18 Shaw Rd., Carver, MA (US) 02330

( * ) Notice: Subject to any disclaimer, the term of this patent is extended or adjusted under 35 U.S.C. 154(b) by 0 days.

(21) Appl. No.: 10/974,326

(22) Filed: Oct. 27, 2004

(65) Prior Publication Data

US 2005/0095066 A1 May 5, 2005

Related U.S. Application Data

(60) Provisional application No. 60/514,950, filed on Oct. 28, 2003.

(51) Int. Cl.[7] ..... E21D 11/00
(52) U.S. Cl. ..... 405/150.1; 405/146; 405/150.2; 405/270; 264/32
(58) Field of Search ..... 405/36, 38, 132, 405/135, 146, 147, 150.1, 150.2, 152, 268–270; 264/31–35

(56) References Cited

U.S. PATENT DOCUMENTS

| | | | | |
|---|---|---|---|---|
| 4,695,188 A | | 9/1987 | Pulkkinen | 405/150 |
| 4,915,542 A | | 4/1990 | Fernando | 405/150 |
| 4,940,360 A | | 7/1990 | Weholt | 405/151 |
| 5,002,438 A | * | 3/1991 | Strong | 405/268 |
| 5,439,319 A | * | 8/1995 | Flanagan et al. | 405/152 |
| 5,470,178 A | * | 11/1995 | Weholt | 405/152 |
| 5,480,260 A | * | 1/1996 | Shattuck et al. | 405/36 |
| 5,645,217 A | | 7/1997 | Warren | 239/75 |
| 5,879,501 A | * | 3/1999 | Livingston | 264/34 |
| 6,402,427 B1 | | 6/2002 | James | 405/150.1 |
| 6,663,016 B2 | | 12/2003 | Bien | 239/130 |
| 6,761,504 B1 | * | 7/2004 | Brandenberger et al. | 405/150.2 |

FOREIGN PATENT DOCUMENTS

| | | | |
|---|---|---|---|
| EP | 898052 | * 2/1999 | |
| JP | 06323100 | * 11/1994 | 405/132 |

* cited by examiner

*Primary Examiner*—Jong-Suk (James) Lee
(74) *Attorney, Agent, or Firm*—Barlow, Josephs & Holmes, Ltd.

(57) ABSTRACT

A method for repairing in-ground tunnel structure involves applying a first curable resin over a cementitious liner which lines the interior wall surfaces of the tunnel, drilling drainage holes in the cementitious liner, and filling the drainage holes with a second curable resin. The resins are allowed to cure and harden. The cured resins seal the wall surfaces and drainage holes to provide a composite tunnel structure having high mechanical strength and resistance to fluid leaks.

10 Claims, 4 Drawing Sheets

METHOD FOR REPAIRING IN-GROUND TUNNEL STRUCTURES

CROSS-REFERENCE TO RELATED APPLICATIONS

This application claims the benefit of U.S. Provisional Application No. 60/514,950 having a filing date of Oct. 28, 2003, the entire contents of which are hereby incorporated by reference.

BACKGROUND OF THE INVENTION

The present invention generally relates to a method for repairing an in-ground tunnel structure. More particularly, the method involves forming water drainage holes in the tunnel structure and sealing the holes with a curable resin such as an epoxy. The method further involves applying a curable resin to the inside wall surfaces of the tunnel to form a hardened resinous liner. The resulting composite tunnel structure has high mechanical strength and is resistant to water leaks.

There are numerous tunnel structures that run underground throughout the world. Railroad tracks, subway tracks, communication cables, electrical lines, and other equipment are laid in such tunnels. In many instances, the tunnels are built in rocky areas. Dynamite and other explosives are used to blast the rock-lined subterranean layers and clear an underground area for building the tunnel. The tunnel structure may be made from a wide variety of materials including rocks, steel, sheet metal, concrete blocks, and bricks. The tunnel structure includes archways, interior walls, and ground platform sections. If concrete blocks or bricks are used to fabricate the tunnel structure, these materials typically are held together by cement, mortar, or other bonding agents. In addition, the interior walls of the tunnel typically are lined with a cementitious liner. The cementitious liner can be produced by applying a cement mixture over the interior walls and smoothing-out the mixture to form a uniform cementitious layer. The cementitious layer provides a smooth and hard lining for the interior surface of the tunnel. Moreover, the cementitious liner helps to seal the interior walls and prevent fluids from leaking into the passageway of the tunnel.

However, over a period of time, the tunnel tends to deteriorate due to ordinary aging, corrosive action of fluids being transported in the tunnel, unusual environmental conditions, and other reasons. Cracks, holes, and other defects may develop in the walls of the tunnel. If the wall structure of the tunnel decays substantially, then ground water may seep or flow freely through the tunnel walls. The penetration of the ground water into the tunnel passageway may cause hazardous conditions.

For example, in cold climates, the seeping water may freeze and form icebergs, icicles, and other icy buildup. If the icy buildup comes into contact with a high voltage line (for example, a line having 13,200 volts), the line can ground out. This can lead to fire, explosions, and other hazardous conditions. Any electrical lines or communication cables that are running through the tunnel can be damaged or destroyed.

There are various known methods for rehabilitating existing underground tunnel structures. For example, Pulkkinen, U.S. Pat. No. 4,695,188 discloses a method for treating a rock cistern or tunnel that may be used to store pressurized gases and liquids. The method involves coating an inner lay with a tightly sealing material such as plastic, steel, or concrete fibers. An intermediate layer comprising a steel-reinforced, water-tight, concrete composition is sprayed over the inner layer. An outer layer comprising a concrete mixture of haydite, sand, cement, swelling agents, and water-conducting fibers is sprayed over the intermediate layer. The outer layer is water-permeable and used for conducting the ground water.

Fernando, U.S. Pat. No. 4,915,542 discloses a method of waterproofing the inner surfaces of tunnels, channels and mine galleries. In the method described in the '542 patent, sheets of material are unrolled and cut in situ and applied to the inner wall surfaces. Holes are cut into the walls through the sheets and anchors are attached to the walls. The sheets are waterproof and fireproof, provide good thermal insulation properties, have tear-resistance and moisture-resistance features, and are heat-sealable.

Weholt, U.S. Pat. No. 4,940,360 discloses an insulating and rehabilitation system for the prevention of ice buildup on tunnel arches, walls, and base sections. The tunnel liner system comprises a combination of prefabricated modular wall panels and arch panels that conform with the dimensions and clearance requirements of the tunnel. The liner panels are joined together by cam-lock fasteners. A lightweight, chemically-hardening structural fill composition can be injected in the voids located between the rock face of the tunnel and liner panels. The structural fill composition can include a mixture of polystyrene beads, wetting agents, organic fibers, Portland cement, and sand.

James, U.S. Pat. No. 6,402,427 discloses a method for reinforcing the brick lining of a tunnel. The method involves cutting T-shaped grooves into the brick lining. One or more reinforcement rods, which are encased in a fabric sleeve, are inserted through the narrow mouth of each groove (the stem region of the "T") so that they rest within the enlarged part of the groove (the cross-bar region of the "T"). Grout is injected into the fabric sleeve so that it expands against the groove, and some grout seeps through the sleeve to bond to the brick lining. Anchoring holes may be drilled through the brick lining and into the surrounding rock. Expansion bolts are inserted into the anchoring holes and secured to the ends of the reinforcement rods.

Although the above-described conventional methods of lining tunnel structures with fabricated sheets and panels can be effective somewhat in rehabilitating such structures, these repair methods can be cumbersome and time-consuming. For instance, the modular sheets and panels must be fitted carefully inside of the tunnel so that they conform tightly to the archways and wall sections. After this fitting step has been completed, the sheets and panels must be fastened in place by anchors, bolts, and the like. Furthermore, the modular liner sheets and panels and other materials used in these conventional repair systems can be costly.

There is a need for an improved method for repairing in-ground tunnel structures that does not involve installing sheets, panels, and other mechanical supports in the tunnel. The method should be relatively quick and practical so that it can be used on a wide variety of tunnel structures. The method should also be economically feasible. The present invention provides such an improved method for repairing in-ground tunnels. The improved method involves applying a first curable resin to the interior wall surfaces of the tunnel, drilling drainage holes in the wall structure of the tunnel, and filling the drainage holes with a second curable resin. The resins are allowed to cure and harden, thereby sealing the wall surfaces and drainage holes. The resulting composite tunnel structure has high mechanical integrity and is resistant to water leaks. These and other objects, features, and advantages of this invention are evident from the following description and attached figures.

SUMMARY OF THE INVENTION

The present invention relates to a method for repairing in-ground tunnel structures. The tunnels have an interior wall surface that is lined with a cementitious liner. The method comprises the steps of: a) cleaning the cementitious liner; b) forming at least one drainage hole in the cementitious liner; c) applying a first curable resin to the cementitious liner and allowing the resin to cure to form a resinous liner that is bonded to the cementitious liner; and d) introducing a second curable resin into the drainage hole and allowing the resin to cure and seal the hole.

The cementitious liner can be cleaned by spraying the liner with pressurized water. Multiple drainage holes typically are formed in the cementitious liner, and the holes can be formed by drilling the liner with a hammer drill or other suitable equipment. Bleeder tubes are inserted preferably in the drainage holes to remove water away from the work area.

The first curable resin can be applied by spraying the resin onto the cementitious liner, and the second curable resin can be introduced into the drainage holes by pumping the resin into the holes. Any suitable curable resin can be used in the method of this invention. Preferably, a relatively fast-curing heated epoxy resin is used as the first and second curable resin.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description taken in connection with the accompanying drawings in which:

DETAILED DESCRIPTION OF THE PREFERRED EMBODIMENTS

The method of the present invention relates to repairing in-ground tunnel structures. By the term, "tunnel structure" as used herein, it is meant any hollow conduit. For instance, the method can be used to repair in-ground, channeled structures that house railroad tracks, subway tracks, communication cables, electrical lines, and the like. In addition, the method can be used to repair in-ground pipelines such as water lines, sewer pipes, storm water drains, and the like.

Figure 1:
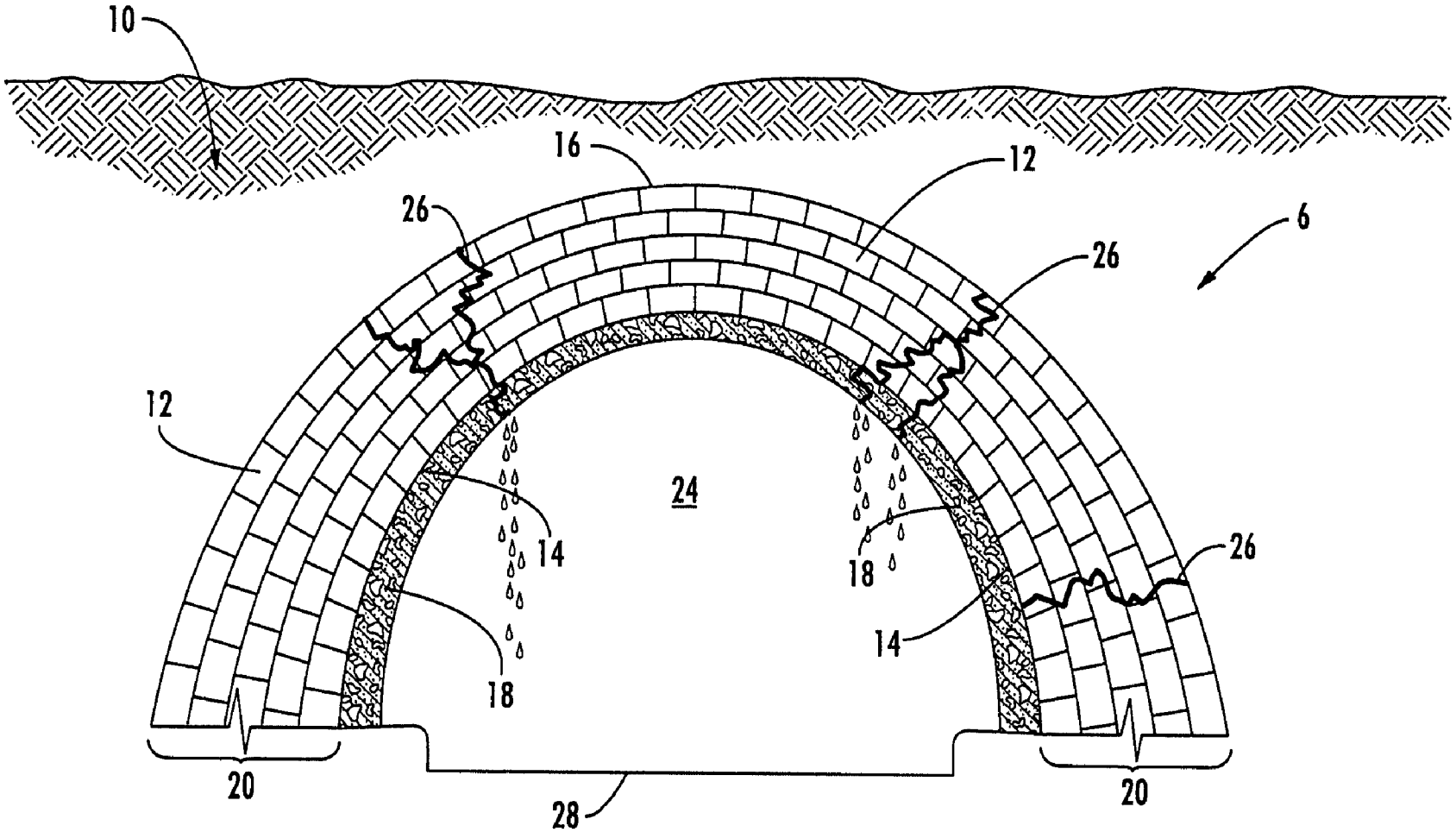
FIG. 1 is a vertical cross-sectional view of a tunnel structure before it is repaired in accordance with the method of the present invention.

Referring to FIG. 1, a vertical cross-section view of a typical tunnel structure is shown. The tunnel is generally indicated at 6, and the tunnel 6 is installed in a ground area generally indicated at 10. The tunnel 6 can be made of concrete blocks or bricks 12 that are held together by mortar or other suitable adhesive materials. The tunnel 6 in FIG. 1 is shown as being constructed from concrete blocks or bricks 12 for illustration purposes only, and it should be recognized that the tunnel 6 can be made from a wide variety of materials including rocks, steel, and sheet metal as discussed above. In FIG. 1, the tunnel structure 6 includes interior wall portions 14 and exterior wall portions 16. A relatively thick cementitious composition 18 lines the interior wall portions 14. This cementitious lining 18 is designed to seal the tunnel wall structure 20 and prevent fluids from leaking into the tunnel passageway 24. The cementitious liner 18 further helps strengthen and maintain the structural integrity of the tunnel wall structure 20. Such cementitious liners 18 are commonly used to line the interior wall surfaces 14 of the tunnels 6. The cementitious liner 18 is prepared ordinarily by coating a cement mixture over the interior wall surfaces 14 so that it forms a uniformly coated layer. Such cement mixtures are known in the industry. The cement mixture may contain Portland cement, lime, alumina, silica, reinforcing fibers, and various additives as is known in the art.

In spite of the cementitious liner 18, the structure of the tunnel 6 tends to decay and deteriorate over a period of time. This deterioration can be due to a variety of reasons such as ordinary aging or changing environmental conditions as discussed above. For example, the cementitious liner 18 is often exposed to freezing and thawing conditions. As the liner 18 contracts and expands, it can spall. The fragmentary pieces and chips of the liner 18, which break-off during the spalling, lead to further deterioration of the tunnel structure. Also, soil, chemicals, and other foreign debris tend to accumulate on the cementitious liner 18 over the lifetime of the tunnel 6. This foreign material forms hard scale deposits that can further corrode the liner structure 18. In addition, the concrete blocks or bricks 12, which constitute the wall structure 20, are held together by a cement mortar or other adhesive. But, pores and voids can form eventually in the mortar. These porous defects can lead to a decrease in the strength and adhesive properties of the mortar. As the adhesive bonds between the concrete blocks or bricks 12 in the tunnel structure 6 weaken, fragmentary pieces of the blocks and bricks 12 can break-off.

As the overall tunnel structure 6 continues to deteriorate, fissures and larger cracks 26 can develop in the walls 20 of the tunnel 6 and penetrate through the cementitious liner 18. As these cracks form and propagate throughout the wall structure 20, water from the surrounding ground areas 10 will penetrate into the walls. This seeping and infiltration of the ground water further corrodes the wall structure 20. As the ground water leaks through the wall structure 20, it may collect and pool at the bottom region 28 of the tunnel 6. Also, as discussed above, in cold conditions, the leaking ground water may freeze and ice may build up. If the icy buildup comes into contact with a high voltage line in the tunnel 6, the line can ground out leading to fire, explosions, and other hazardous conditions. Any electrical lines or communication cables running through the tunnel 6 can be damaged or destroyed.

The present invention provides a method for repairing such damaged tunnel structures 6. First, in accordance with this invention, the cementitious liner 18, which lines the inside wall surfaces 14 of the tunnel 6, is cleaned.

This cleaning step is important, because it allows a curable resin, such as an epoxy, that is applied subsequently to the cementitious liner 18 to bond tightly to the liner 18. The application and bonding of the curable resin to the cementitious liner 18 is described in further detail below.

Preferably, the cementitious liner 18 is cleaned by injecting highly pressurized water onto the liner 18. Known power-washing devices can be used to apply the pressurized water. The water is generally sprayed at a pressure in the range of about 4,000 to about 20,000 pounds per square inch (psi) to effectively clean the surfaces of the liner 18, but it is understood that the pressure of the water is not restricted to this range, and the water may be applied at any appropriate compressive strength. The pressurized water stream scrubs the cementitious liner 18 forcefully to remove debris and produce a clean, smooth surface. Highly-pressurized water is used preferably to clean the cementitious liner 18. But, it is recognized that other cleaning media such as compressed air or steam may be employed as well.

In addition, chemical cleaners such as detergents may be used to thoroughly clean the cementitious liner 18 if needed. But, the use of such chemical cleaners is not recommended, because they may interfere with the application of the epoxy or other resin. If such chemical detergents are used, then the cementitious liner 18 should be treated subsequently with clean water to remove any chemical residue.

After this surface cleaning and preparation step has been completed, any standing water left in the bottom portion 28 of the tunnel passageway 24 is removed. In one embodiment, highly-pressurized air can be injected into the passageway 24 to clear the standing water. In other embodiment, the standing water is allowed to flow naturally into drains (not shown) located at the bottom portion 28 of the tunnel passageway 24.

Figure 2:
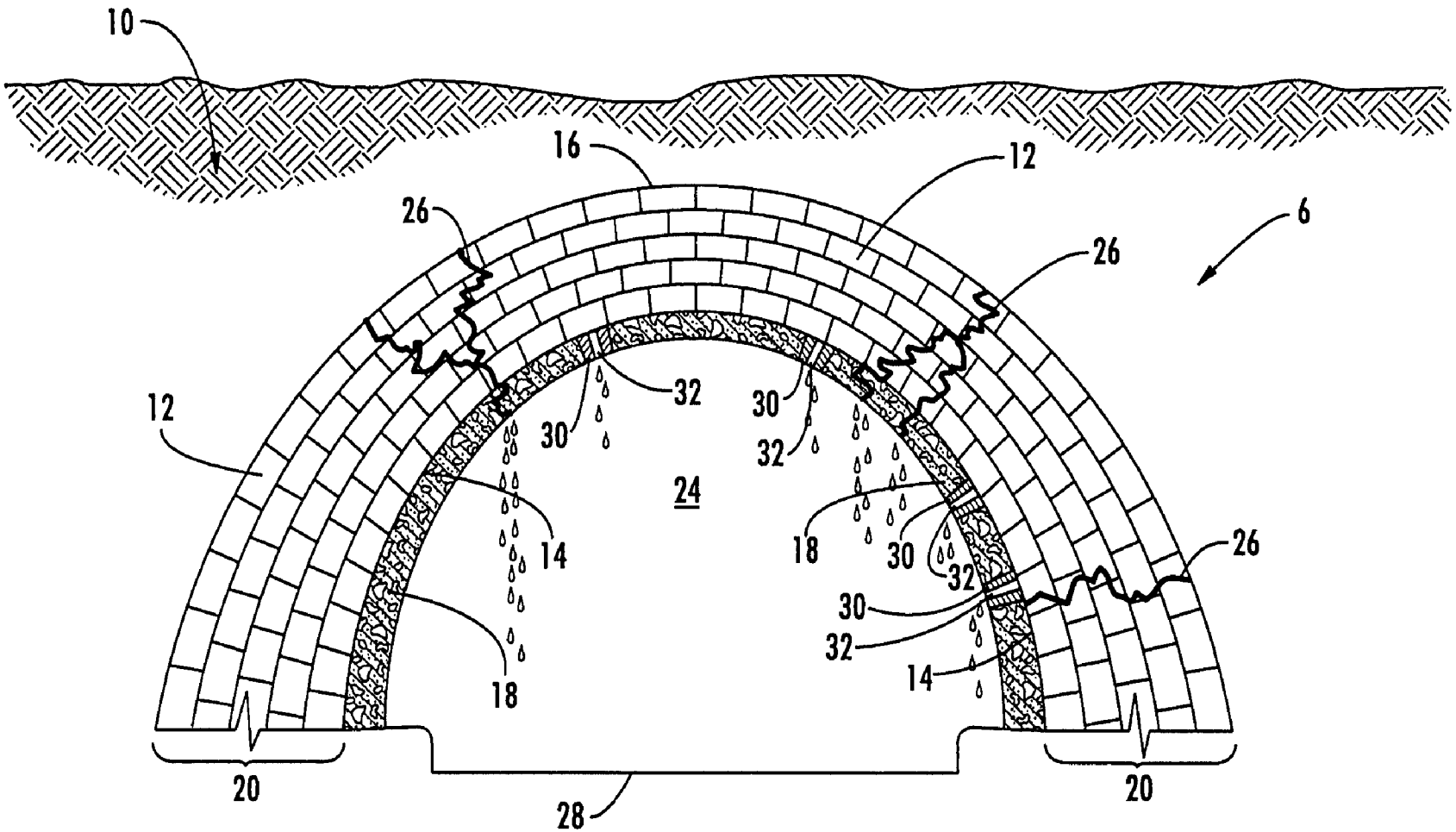
FIG. 2 is a vertical cross-sectional view of the tunnel structure in FIG. 1 showing drainage holes formed in the walls of the tunnel.

Turning to FIG. 2, at least one drainage hole 30 in the cementitious liner 18 then is formed. Preferably, multiple drainage holes 30 are produced as shown in FIG. 2. The drainage holes 30 can be formed so that they either penetrate the cementitious liner 18 partially or completely. As an operator drills the drainage holes 30, he or she may strike pockets of water and high water-pressure points. The operator may continue drilling the drainage holes 30 through these water pockets and high pressure points or stop the drilling operation.

The drainage holes 30 can be formed in any suitable manner, but typically the operator creates the drainage holes 30 by drilling openings into the cementitious liner 18. The drainage holes 30 can be bored using conventional hole-boring equipment such as a hammer drill and rotary drill bits. The dimensions of the drainage holes 30 are not restricted. The drainage holes 30 can be of any suitable diameter but typically have a diameter in the range of about one-half (½) to about one (1) inch. The drainage holes 30 are drilled near the areas where the ground water is leaking into the tunnel passageway 24 in order to help control the pressure of the ground water. As the ground-water is channeled into the drainage holes 30, the water pressure exerted on the wall structure 20 and particularly the pressure on the cementitious lining 18 is relieved temporarily.

Bleeder tubes 32 are preferably placed in the drainage holes 30 to help remove the flowing water away from the work area. If desired, the drainage holes 30 can be cleaned with highly pressurized air before inserting the bleeder tubes 32 therein. The positioning of the bleeder tubes 32 in the drainage holes is also illustrated in FIG. 2. The tubes 32 are made of a strong and durable material. For example, the bleeder tubes 32 can be made of such materials as plastics, metals, fabrics, and the like. Particularly, materials such as polyvinyl chloride, polyurethane, polypropylene, polyethylene, and polyesters can be used to construct the bleeder tubes 32.

Next, a first curable resin, such as an epoxy, is applied over the cementitious liner 18. The resin is applied in a generally uncured, liquid form and then allowed to cure and harden. The resin is applied in a heated state. The temperature of the resin is typically in the range of about 140° F. to about 180° F. The heated resin cures in a relatively short period of time. For example, an epoxy resin, that substantially cures in a time period of about 2 to about 4 hours after it has been applied to the cementitious liner 18, may be used.

The resin can be applied onto the cementitious liner 18 using any suitable application technique. Preferably, the resin is sprayed onto the cementitious liner using a spray application system as described in Warren, U.S. Pat. No. 5,645,217, ("the '217 patent") the disclosure of which is hereby incorporated by reference. As described in the '217 patent, this spray application system is particularly adapted for spray-applying a two-part, self-setting compound such as an epoxy. The spray applicator delivers the two-parts at a temperature that promotes their spray application as well as their self-setting reaction. It is also recognized that other spray applicators can be used to apply the resin over the cementitious liner 18 in accordance with the method of this invention.

Figure 3:
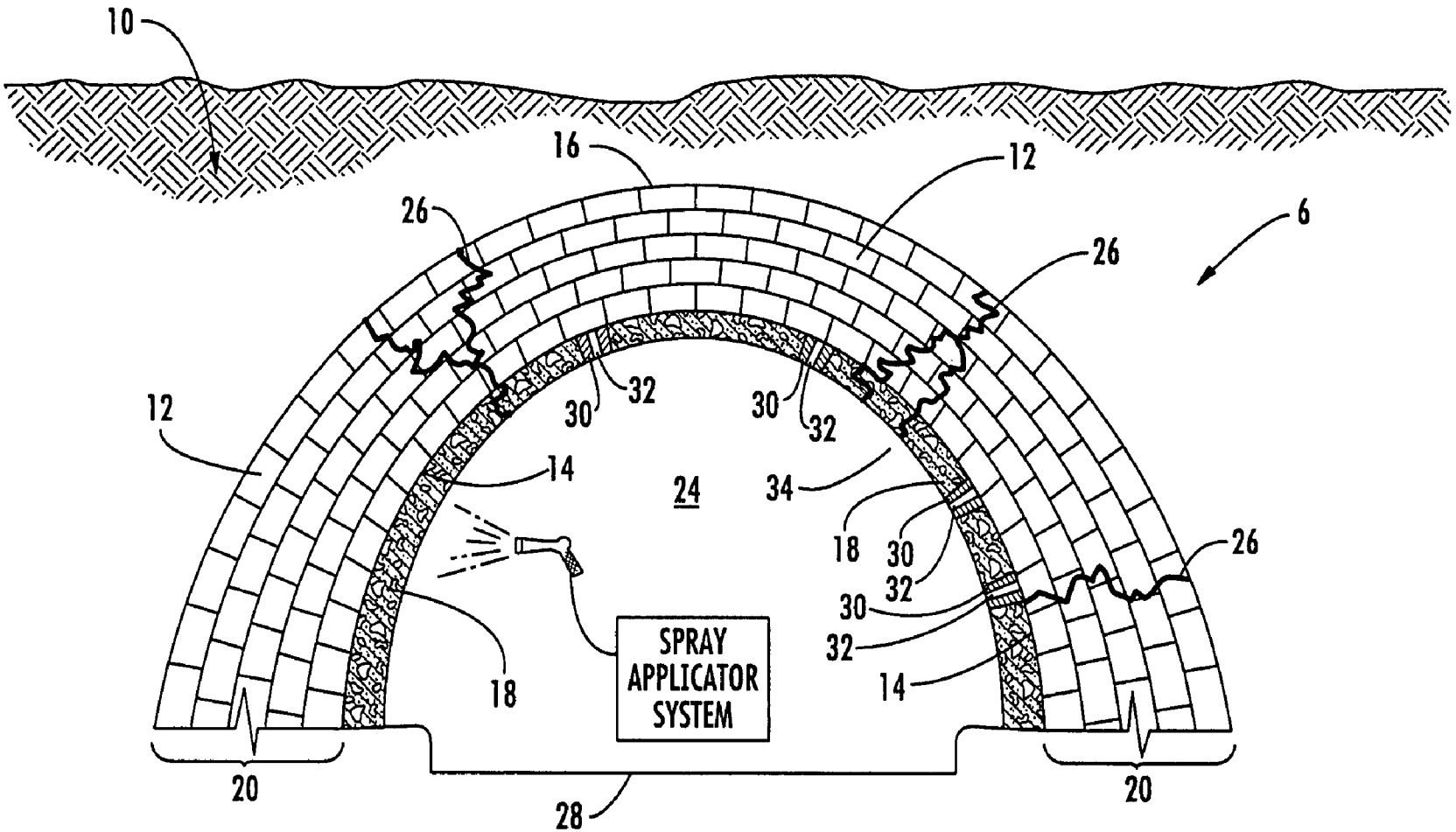
FIG. 3 is a view of the tunnel structure shown in FIG. 1 showing the first curable resin being applied to the inside wall surfaces of the tunnel by a spray application system.

Referring to FIG. 3, the resin is shown being applied by a spray applicator system. The resin is applied so that it forms a uniform, smooth resinous liner 34 (FIG. 4) that overlays the cementitious liner 18. The resin may be applied at any suitable thickness. Normally, the resin is applied at a thickness in the range of about one-quarter (¼) to about two (2) inches, and preferably the resin is coated over the cementitious liner 18 uniformly at a thickness of about ¼ inches.

Many different types of curable resins can be used for producing the resinous liner 34, which overlays the cementitious liner 18, in accordance with the method of this invention. The curable resin should have high bond and mechanical strength properties. Particularly, the resin should have high compressive, tensile, and flex strength properties. For example, polyesters; vinyl esters such as urethane-based vinyl esters; and bisphenol A-fumarate based vinyl esters; and epoxy resins can be used. Epoxy resins are particularly preferred because of their strong bonding and mechanical properties. The epoxy resin should be capable of being applied to wet surfaces and have good water-resistant properties. For instance, two-part epoxy resins, which are described in the foregoing '217 patent, can be used.

The first curable resin is applied over the cementitious liner 18 in a generally uncured, liquid form. This first resin is applied to the cementitious liner 18 so that it surrounds the drainage holes 30 and projecting bleeder tubes 32. This first resin is not designed to be injected into the drainage holes 30, although it is recognized that some of the resin may flow inadvertently into the holes 30. Rather, a second curable resin is used to plug the drainage holes 30 as described in further detail below.

After the first curable resin has been applied over the cementitious liner 18, it is allowed to cure and harden. The curing reaction is exothermic so the curing of the resin, itself, generates heat that improves the curing rate. Also, the resins may contain heat-initiated curing agents which accelerate the curing process. Upon curing and hardening of the coated resin, a structural resinous liner 34 is formed that bonds firmly to the cementitious liner 18 overlaying the inside wall surfaces 14 of the tunnel 6. The resinous liner 34 is a smooth and hard ceramic-like material, and it is difficult to break or chip-off pieces of the liner 34. The resinous liner 34 forms a tight, water-resistant seal over the cementitious liner 18.

Then, a second curable resin, which can also be an epoxy, is introduced into the previously bored drainage holes 30. If bleeder tubes 32 were placed in the drainage holes 30, then the tubes 32 are removed prior to injecting the resin into the holes 30. If desired, the drainage holes 30 can be cleaned with highly pressurized air before injecting the resin therein. However, this cleaning step is not necessary particularly if an epoxy resin, that is designed to be applied under water or to wet surfaces, is used.

The second curable resin is injected into the drainage holes 30 in a generally uncured, liquid form and in a heated state. The temperature of the second resin is typically in the range of about 180° F. to about 220° F. At this temperature, the resin can be pumped efficiently so that it flows into the drainage holes 30 and plugs the holes 30.

The heated second curable resin is pumped into the drainage holes 30 under high pressure. For example, the heated second resin can be injected at a pressure within the range of about 2000 to about 3000 psi. The second resin can be pumped into the drainage holes 30 using standard pumping equipment known in the industry such as air-powered epoxy or grout pumps. The heated second resin cures in a very short period of time and has high compressive, tensile, and flex strength properties. Polyesters; vinyl esters such as urethane-based vinyl esters; and bisphenol A-fumarate based vinyl esters; and epoxy resins are examples of suitable resins that can be used. Preferably, an epoxy resin, that substantially cures in a time period of about 3 to about 10 minutes, is used to seal the drainage holes 30. This fast-curing resin hardens to form a plug that seals the drainage holes 30 and any surrounding cracks and fissures. This hardened plug is highly resistant water leaks and to cracking and chipping. The plugging of the drainage holes 30 helps reinforce the structure of the tunnel 6.

Figure 4:
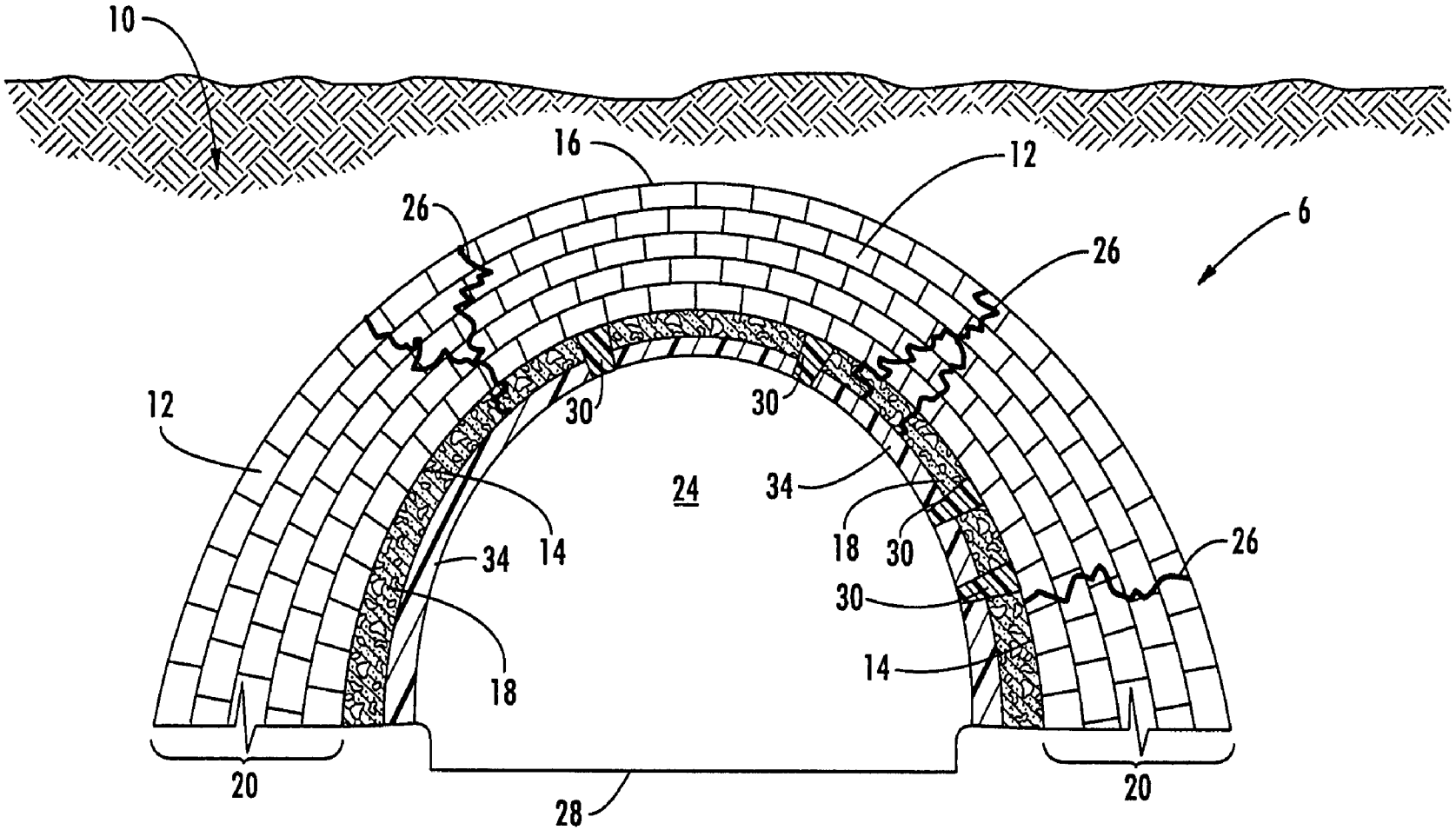
FIG. 4 is a view of a tunnel structure that has been repaired in accordance with the method of this invention.

The resulting tunnel 6, which has been repaired in accordance with the method of this invention, has a composite structure as shown generally in FIG. 4. As illustrated in FIG. 4, the wall structure 20 of the tunnel 6 has-been sealed by applying a first curable resin over the cementitious liner 18 which lines the inside wall surfaces 14. The first resin has cured and hardened to form a smooth structural resinous liner 34 that overlays the cementitious liner 18. The resinous liner 24 helps reinforce and seal the wall structure 20. Furthermore, a second curable resin has been injected into the drainage holes 30 in the tunnel structure 6 shown in FIG. 4. The second resin has cured and hardened to plug and seal the drainage holes 30. The resulting tunnel 6 is a composite structure having high mechanical strength and integrity. The wall structure 20 of the tunnel 6 is sealed tightly by the method of this invention so that water and other fluids are prevented from leaking substantially into the tunnel passageway 24.

Although the present invention has been described with reference to preferred embodiments, workers skilled in the art will recognize that changes may be made in form and detail without departing from the spirit and scope of the invention. For instance, in other embodiments of this invention, a reinforcing material (not shown) coated with an epoxy or other curable resin can be applied over expansion joints (not shown) located in the tunnel structure 6 for additional reinforcement. A reinforcing material having a plastic or rubber outer layer and an inner fibrous layer can be used. For instance, the outer layer can be made of polyvinyl chloride, polyurethane, polyethylene, polypropylene, or the like, and the inner layer can be made of a non-woven fibrous material such as needle-point felt. The epoxy resin is applied to the inner felt layer which has good resin-absorbency properties. The inner felt layer is then brought into contact with the expansion joint and the resin is cured.

The epoxy resin may be self-curing or forced to cure by applying heat. As the epoxy resin cures and hardens, the reinforcing material bonds to the expansion joints to form a reinforced structural area. The resulting composite structure has high mechanical strength and integrity. All such modifications and changes to the illustrated embodiments herein are intended to be covered by the appended claims.

What is claimed is:

1. A method for repairing an in-ground tunnel structure having an interior wall surface lined with a cementitious liner, comprising the steps of:

a) cleaning the cementitious liner;

b) forming at least one drainage hole in the cementitious liner;

c) applying a first curable resin to the cementitious liner and allowing the resin to cure to form a resinous liner that is bonded to the cementitious liner; and d) introducing a second curable resin into the at least one drainage hole and allowing the resin to cure and seal the hole.

2. The method of claim 1, wherein the cementitious liner is cleaned by treating the liner with pressurized water.

3. The method of claim 1, wherein the drainage hole is formed in the cementitious liner by drilling the hole therein.

4. The method of claim 1, wherein a bleeder tube is placed in the drainage hole to remove water.

5. The method of claim 1, wherein multiple drainage holes are formed in the cementitious liner.

6. The method of claim 1, wherein the first curable resin is applied to the cementitious liner by spraying the resin onto the liner.

7. The method of claim 1, wherein the second curable resin is introduced into the drainage hole by pumping the resin into the hole.

8. The method of claim 1, wherein the first curable resin is an epoxy resin.

9. The method of claim 1, wherein the second curable resin is an epoxy resin.

10. The method of claim 1, wherein the first and second curable resins are each epoxy resins.

* * * * *